US006355130B1

(12) United States Patent
Sogabe et al.

(10) Patent No.: US 6,355,130 B1
(45) Date of Patent: Mar. 12, 2002

(54) THERMAL TRANSFER RECORDING MEDIUM

(75) Inventors: Jun Sogabe; Tetsuo Hoshino, both of Osaka; Yoshiyuki Asabe, Tokyo-to; Susumu Arauchi, Tokyo-to; Yasutoshi Inoue, Tokyo-to; Osamu Ogiyama, Tokyo-to, all of (JP)

(73) Assignee: Fujicopian Co., Ltd., Osaka-fu (JP)

( * ) Notice: Subject to any disclaimer, the term of this patent is extended or adjusted under 35 U.S.C. 154(b) by 0 days.

(21) Appl. No.: 09/621,099

(22) Filed: Jul. 21, 2000

Related U.S. Application Data

(63) Continuation of application No. 09/092,186, filed on Jun. 3, 1998, now abandoned.

(51) Int. Cl.[7] ..... B44C 1/165

(52) U.S. Cl. ..... 156/235; 428/195; 428/488.4; 428/913; 428/914

(58) Field of Search ..... 428/195, 913, 428/914, 484, 488.1, 488.4; 156/235

(56) References Cited

U.S. PATENT DOCUMENTS

| | | | | |
|---|---|---|---|---|
| 5,002,819 | A | 3/1991 | Tohma et al. | 428/212 |
| 5,053,267 | A | 10/1991 | Ide et al. | 428/195 |

FOREIGN PATENT DOCUMENTS

| | | | |
|---|---|---|---|
| EP | 0 510 661 | A1 | 10/1992 |
| EP | 0 698 504 | A1 | 2/1996 |

*Primary Examiner*—Bruce H. Hess
(74) *Attorney, Agent, or Firm*—Fish & Neave

(57) ABSTRACT

A thermal transfer recording medium for forming a color image by superimposingly transferring plural different color inks, comprising a foundation and a color ink layer provided on the foundation, and a release layer comprising a wax interposed between the foundation and the color ink layer, wherein the thickness $d_1$ of the release layer for a first color and the thickness $d_2$ of the release layer for a second color satisfy the relationship represented by formula (I):

$$d_1 < d_2 < 2.0\ d_1. \quad \text{(I)}$$

2 Claims, 1 Drawing Sheet

THERMAL TRANSFER RECORDING MEDIUM

This is a continuation of copending, commonly-assigned U.S. patent application Ser. No. 09/092,186 filed Jun. 3, 1998, now abandoned.

BACKGROUND OF THE INVENTION

The present invention relates to a thermal transfer recording medium for use in thermal transfer recording devices such as thermal printers and facsimile terminal equipment. More particularly, the present invention relates to a thermal transfer recording medium for the formation of a multi-color or full-color image by the superimposing transfer of plural different color inks.

There has hitherto been conducted the formation of a multi-color or full-color image wherein plural different color inks are superimposingly transferred one on another on a receptor by means of a thermal transfer printing or the like to form a multi-color or full-color image involving a region developing a color by virtue of subtractive color mixture. As the thermal transfer recording medium for such a method there has been widely used one having the structure wherein a release layer comprising a wax as a main ingredient is interposed between a foundation and a color ink layer to improve the transferability.

When plural different color inks are superimposingly transferred to form a multi-color or full-color image on a receptor by use of the above-mentioned thermal transfer recording medium, the release layer comprising a wax as a main ingredient would exist on the top of first color ink dots formed on the receptor, thereby causing the problem wherein second color ink dots are not satisfactorily superimposed onto the first color ink dots due to the presence of the release layer on the first color ink dots.

In view of the aforesaid problem of the prior art, it is an object of the present invention to provide a technique wherein in the case of forming a color image by use of a thermal transfer recording medium having the structure wherein a release layer comprising a wax as a main ingredient is interposed between a foundation and a color ink layer, second color ink dots are satisfactorily transferred onto first color ink dots.

This and other objects of the present invention will become apparent from the description hereinafter.

SUMMARY OF THE INVENTION

This is a continuation of copending, commonly-assigned U.S. patent application Ser. No. 09/092,186 filed Jun. 3, 1998, now abandoned. The present invention provides a thermal transfer recording medium for forming a color image by superimposingly transferring plural different color inks, comprising a foundation and a color ink layer provided on the foundation, and a release layer comprising a wax interposed between the foundation and the color ink layer, wherein the thickness $d_1$ of the release layer for a first color and the thickness $d_2$ of the release layer for a second color satisfy the relationship represented by formula (I):

$$d_1<d_2<2.0\ d_1 \quad \text{(I)}$$

In an embodiment of the present invention, the thickness $d_1$ of the release layer for the first color is from 0.05 to 0.7 $\mu$m.

In another embodiment of the present invention, plural different color ink layers are disposed in a side-by-side relation on single foundation with respective release layers intervening between the foundation and ink layers.

In still another embodiment of the present invention, plural different color ink layers are disposed on separate foundations with respective release layers intervening between the foundations and ink layers.

DETAILED DESCRIPTION

Figure 1:
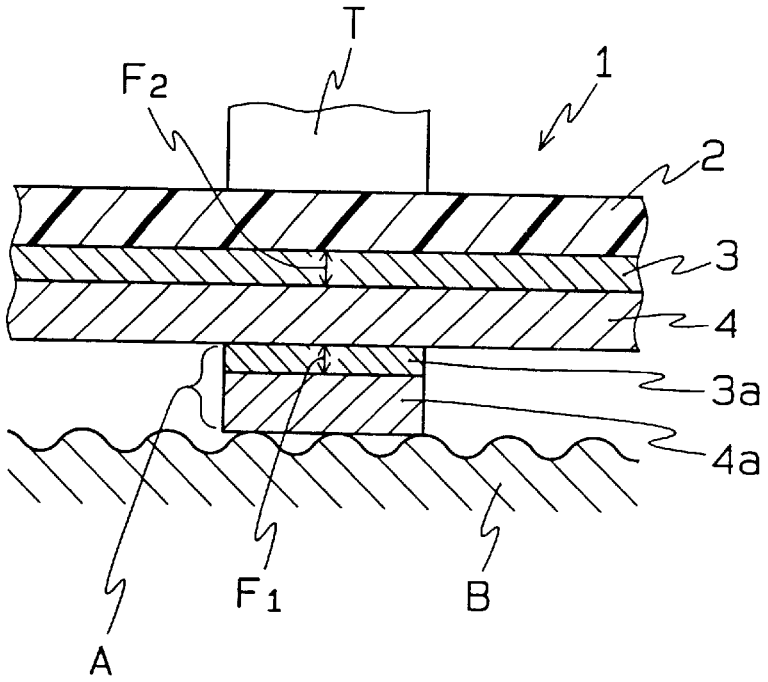
FIG. 1 is a schematic sectional view showing a situation where a color image is formed by superimposing transfer using an example of the thermal transfer recording medium of the present invention on a thermal transfer printer.

The definition of the terms "first color" and "second color" used in the present invention is as follows: When two different color inks are superimposingly transferred one onto the other, the one color which is transferred previous to the other color is "first color", and the other color which is transferred onto the first color is "second color". For example, in the case of superimposingly transferring three different color inks of yellow (hereinafter referred to as "Y" in some cases), magenta (hereinafter referred to as "M" in some cases) and cyan (hereinafter referred to as "C" in some cases) in the order of Y, M and C, Y is a first color and M is a second color when the transfer of Y and M is taken in consideration, and M is a first color and C is a second color when the transfer of M and C is taken in consideration.

The definition of the terms "first release layer" and "second release layer" is as follows: The release layer which is interposed between a foundation and a color ink layer giving a first color is the first release layer. The release layer which is interposed between a foundation and a color ink layer giving a second color is the second release layer.

The thermal transfer recording medium of the present invention has the structure wherein a release layer comprising a wax as a main ingredient is interposed between a foundation and a color ink layer. The thermal transfer recording medium of the present invention includes two embodiments: One embodiment wherein plural different color ink layers are disposed in a side-by-side relation on single foundation with respective release layers intervening between the foundation and ink layers; and another embodiment wherein plural different color ink layers are disposed on separate foundations with respective release layers intervening between the foundations and ink layers.

The thermal transfer recording medium of the present invention is characterized in that the thickness $d_1$ of the first release layer and the thickness $d_2$ of the second release layer satisfy the relationship represented by formula (I):

$$d_1<d_2<2.0\ d_1 \quad \text{(I)}$$

and preferably the relationship represented by formula (II):

$$1.1\ d_1<d_2<1.5\ d_1 \quad \text{(II)}$$

By virtue of the feature that the thickness $d_1$ of the first release layer and the thickness $d_2$ of the second release layer satisfy the relationship represented by formula (I), preferably the relationship represented by formula (II), a desired effect that second color ink dots can be satisfactorily transferred onto first color ink dots is exhibited.

The reason why the above-mentioned effect is exhibited will be explained by referring to the drawing.

FIG. 1 is a schematic sectional view showing the situation where a color image is formed by superimposing transfer using the thermal transfer recording medium of the present invention on a thermal transfer printer.

In FIG. 1, reference numeral 1 denotes a thermal transfer recording medium having the structure wherein a color ink layer 4 is provided on a foundation 2 with a release layer 3 intervening between the foundation 2 and the color ink layer 4. The recording medium 1 shown in FIG. 1 is adapted for the second color and the release layer 3 thereof has a thickness $d_2$. An ink image for the first color has been formed on a receptor (paper) B by using a recording medium for the first color (in FIG. 1, only one ink dot A is illustrated to simplify the explanation). The ink dot A is composed of a color ink layer 4*a* fixed to the receptor B and a release layer 3*a* present on the color ink layer 4*a*.

The recording medium 1 for the second color is superposed on the receptor B having the ink dot A thereon. The combined recording medium 1/receptor B is heated from the side of foundation 2 with a thermal head (in FIG. 1, only one heating element T is illustrated).

The thickness $d_2$ of the release layer 3 for the second color is larger than the thickness $d_1$ of the release layer for the first color and, hence, larger than the thickness of the release layer 3*a* of the ink dot A for the first color. Generally, the thickness of the release layer of an ink dot thermally transferred is the same as or a little smaller than the original thickness of the release layer in the recording medium. After the combined recording medium 1/receptor B is heated with the heating element T in this state and the release layer 3 and the release layer 3*a* are melted, the release layer 3*a* of the ink dot A for the first color is cooled faster than the release layer 3 for the second color. Accordingly, when the recording medium 1 for the second color is peeled off from the receptor B, the cohesive force $F_2$ of the release layer 3 is smaller than the cohesive force $F_1$ of the release layer 3*a* and, as a result, the color ink layer 4 is peeled on the side of the release layer 3, so that an almost perfect ink dot for the second color is transferred onto the ink dot A for the first color. That is, the size of the ink dot for the second color is almost the same as the size of the ink dot A for the first color.

Thus, according to the present invention, ink dots for the second color are superimposingly transferred onto the ink dots in a predetermined region of a first color image, resulting in a desired subtractive color mixture to give a multi-color or full-color image with good color reproducibility.

When $d_1 \geqq d_2$, the ink dots for the second color are not satisfactorily transferred onto the ink dots for the first color, resulting in poor color reproducibility. When $d_2 \geqq 2.0\ d_1$, it is difficult to transfer the ink dots for the second color with the printing energy of the same level as that required for the transfer of the ink dots for the first color, resulting in complexity in setting the printing energy. As a result, in the present invention it is preferable that $d_1$ and $d_2$ satisfy the relationship represented by formula (II):

$$1.1\ d_1 < d_2 < 1.5\ d_1 \qquad \text{(II)}$$

In the present invention, the thickness $d_1$ of the first release layer is preferably from 0.05 to 0.7 $\mu$m. When the thickness of the first release layer is smaller than the above range, the releasability of the release layer is prone to be insufficient. When the thickness of the second release layer is larger than the above range, the first release layer for the first color is not cooled faster than the second release layer during the transfer of the ink dots for the second color onto the ink dots for the first color, and the cohesive failure is likely to occur within the first release layer resulting in unsatisfactory superimposing transfer of the ink dots for the second color.

When three colors, Y, M and C, are transferred in the order of Y, M and C, it is preferable that the thickness $d_1$ of the release layer for a first color is within the aforesaid range both in the case that a second color M is transferred onto a first color Y and in the case that a second color C is transferred onto a first color M.

With respect to other constituents of the thermal transfer recording medium of the present invention, conventional ones can be adopted without any particular limitation so long as the release layers have respective thicknesses satisfying the aforesaid condition.

As the color ink layer yellow, magenta and cyan ones are usually used. A black ink layer is optionally used. Usually, however, the black ink layer is not superimposed on other color ink layers. In that case, the release layer corresponding to the back ink layer does not need to satisfy the aforesaid condition.

These yellow, magenta and cyan ink layers and optionally a black ink layer may be disposed either on separate foundations or on single foundation.

According to an example of the thermal transfer recording medium wherein the respective color ink layers are disposed on single foundation, a yellow ink layer, a magenta ink layer and a cyan ink layer and optionally a black ink layer, each of which preferably has a given constant size, are repeatedly arranged in a side-by-side relation on single foundation in a recurring unit wherein the yellow, magenta and cyan ink layers and optionally the back ink layer are arranged in a predetermined order. The order of arrangement of these three or four ink layers in the recurring unit can be arbitrarily determined in consideration of the superimposing order of the respective color ink layers or the like. The respective release layers which are interposed between the foundation and the color ink layers in correspondence to the yellow, magenta and cyan ink layers and optionally the black ink layer are formed to have respective thicknesses satisfying the aforesaid condition in consideration of the transfer order of the respective color ink layers.

An example of the thermal transfer recording medium wherein the respective color ink layers are disposed on separate foundations comprises a combination of thermal transfer recording media comprising a first thermal transfer recording medium having a yellow ink layer on a first foundation, a second thermal transfer recording medium having a magenta ink layer on a second foundation and a third thermal transfer recording medium having a cyan ink layer on a third foundation, and optionally a fourth thermal transfer recording medium having a black ink layer on a fourth foundation. The respective release layers which are interposed between the respective foundations and color ink layers in correspondence to the yellow, magenta and cyan ink layers and optionally the black ink layer are formed to have respective thicknesses satisfying the aforesaid condition in consideration of the transfer order of the respective color ink layers.

Each of the release layers comprises a wax as a main ingredient thereof and may be incorporated with a thermoplastic resin, as required.

Examples of specific waxes include natural waxes such as lanolin, carnauba wax, candelilla wax, montan wax and ceresine wax; petroleum waxes such as paraffin wax and microcrystalline wax; synthetic waxes such as oxidized wax, synthetic ester wax, low molecular weight polyethylene wax, α-olefin-maleic anhydride copolymer wax, urethane wax, Fischer-Tropsch wax and synthetic petroleum wax. These waxes can be used either alone or in combination.

Examples of specific thermoplastic resins include ethylene-vinyl acetate copolymer, ethylene-alkyl (meth) acrylate copolymer, vinyl chloride-vinyl acetate copolymer, polyesters, polyamides, epoxy resins, petroleum resins and rosin resins. These resins can be used either alone or in combination.

The desired effect of the present invention can be effectively exhibited when the first release layer and the second release layer are the same or similar with each other in their compositions and/or physical properties. For example, with respect to the physical properties, it is preferable that the melting point and/or the melt viscosity of the first release layer are the same as or similar to the melting point and/or the melt viscosity of the second release layer within the melting point range of 60° C. to 90° C. and the melt viscosity range of 1 to 1,000 cps/100° C.

Each of the color ink layers useful in the present invention is a heat-sensitive transferable color ink layer and comprises a coloring agent and a thermoplastic vehicle as main ingredients. The thermoplastic vehicle comprises a wax and/or a thermoplastic resin. The desired effect of the present invention can be outstandingly exhibited when the color ink layer is one having relatively high cohesive force wherein the vehicle thereof comprises a thermoplastic resin as a main ingredient. For this reason, each color ink layer preferably has a melt viscosity of $10^3$ to $10^6$ cps/160° C.

Examples of specific waxes include natural waxes such as lanolin, carnauba wax, candelilla wax, montan wax and ceresine wax; petroleum waxes such as parafin wax and microcrystalline wax; synthetic waxes such as oxidized wax, synthetic ester wax, low molecular weight polyethylene wax, α-olefin-maleic anhydride copolymer wax, urethane wax, Fischer-Tropsch wax and synthetic petroleum wax. These waxes can be used either alone or in combination.

Examples of specific thermoplastic resins (inclusive of elastomers) include ethylene copolymers such as ethylene-vinyl acetate copolymer, ethylene-vinyl butyrate copolymer, ethylene-(meth)acrylic acid copolymer, ethylene-alkyl (meth)acrylate copolymer wherein examples of the alkyl group are those having 1 to 16 carbon atoms, such as methyl, ethyl, propyl, butyl, hexyl, heptyl, octyl, 2-ethylhexyl, nonyl, dodecyl and hexadecyl, ethylene-acrylonitrile copolymer, ethylene-acrylamide copolymer, ethylene-N-methylolacrylamide copolymer and ethylene-styrene copolymer; poly(meth)acrylic acid esters such as polylauryl methacrylate and polyhexyl acrylate; vinyl chloride polymer and copolymers such as polyvinyl chloride, vinyl chloride-vinyl acetate copolymer and vinyl chloride-vinyl alcohol copolymer; polyesters, polyamides, epoxy resins, cellulose resins, natural rubber, styrene-butadine copolymer, isoprene polymer and chloroprene polymer; petroleum resins, rosin resins, terpene resins and cumarone-indene resins. These resins can be used either alone or in combination.

Coloring agents for yellow, magenta and cyan useful in the respective color ink layers are preferably transparent ones.

Examples of specific transparent coloring agents for yellow include organic pigments such as Naphthol Yellow S, Hansa Yellow 5G, Hansa Yellow 3G, Hansa Yellow G, Hansa Yellow GR, Hansa Yellow A, Hansa Yellow RN, Hansa Yellow R, Benzidine Yellow, Benzidine Yellow G, Benzidine Yellow GR, Permanent Yellow NCR and Quinoline Yellow Lake, and dyes such as Auramine. These coloring agents may be used either alone or in combination.

Examples of specific transparent coloring agents for magenta include organic pigments such as Permanent Red 4R, Brilliant Fast Scarlet, Brilliant Carmine BS, Permanent Carmine FB, Lithol Red, Permanent Red F5R, Brilliant Carmine 6B, Pigment Scarlet 3B, Rhodamine Lake B, Rhodamine Lake Y and Arizalin Lake, and dyes such as Rhodamine. These coloring agents may be used either alone or in combination.

Examples of specific transparent coloring agents for cyan include organic pigments such as Victoria Blue Lake, metal-free Phthalocyanine Blue, Phthalocyanine Blue and Fast Sky Blue, and dyes such as Victoria Blue. These coloring agents may be used either alone or in combination.

The term "transparent pigment" herein refers to a pigment which gives a transparently colored ink when dispersed in a transparent vehicle.

Examples of coloring agents for black include pigments such as carbon black and Aniline Black, and dyes such as Nigrosine. These coloring agents may be used either alone or in combination.

The content of the coloring agent in each color ink layer is preferably from about 5 to about 60% by weight. Each color ink layer may be incorporated with a dispersing agent, an antistatic agent or the like, as required. The thickness of each color ink layer is preferably from about 0.5 to about 2.0 μm.

As the foundation for the thermal transfer recording medium of the present invention, one can use polyester films such as polyethylene terephthalate film, polyethylene naphthalate film and polyarylate film, polycarbonate film, polyamide film, aramid film, and other various plastic films commonly used for the foundation of ink ribbons of this type. Thin paper sheets of high density such as condenser paper can also be used. A conventionally known sticking-preventive layer may be provided on the back side (the side adapted to come into slide contact with a thermal head) of the foundation. Examples of the materials for the sticking-preventive layer include various heat-resistant resins such as silicone resins, fluorine-containing resins and nitrocellulose resins, and other resins modified with these heat-resistant resins, such as silicone-modified urethane resins and silicone-modified acrylic resins, and mixtures of the foregoing heat-resistant resins and lubricating agent. The thickness of the foundation is usually from about 1 to about 10 μm. From the viewpoint of reducing heat spreading to increase the resolution of images, the thickness of the foundation is preferably from 1 to 4.5 μm.

The formation of a color image with use of the thermal transfer recording medium of the present invention is preferably performed as follows: With use of a thermal transfer printer, the yellow ink layer (including the color ink layer and the corresponding release layer, hereinafter the same), the magenta ink layer and the cyan ink layer are selectively melt-transferred onto a receptor in a predetermined order according to respective separation color signals of an original color image, i.e. yellow signals, magenta signals and cyan signals to form yellow ink dots, magenta ink dots and cyan ink dots on the receptor in a predetermined order, yielding a yellow separation image, a magenta separation image and a cyan separation image superimposed on the receptor. The order of transfer of the yellow ink layer, the magenta ink layer and the cyan ink layer can be determined as desired. When a usual color image is formed, all the three color ink layers are selectively transferred according to three color signals to form three color separation images on the receptor. When only two color signals are present, the corresponding two of the three color ink layers are selectively transferred to form two color separation images of a yellow separation image, a magenta separation image and a cyan separation image. Thus there is obtained a multi-color or full-color image involving a color region wherein a color is developed by virtue of subtractive color mixture of two or three superimposed color inks.

Of course, the thermal transfer recording medium of the present invention can also be applied to the formation of a color image wherein superimposing transfer is performed by a heating means other than the thermal head, for example, irradiation with laser beam.

PREFERRED EMBODIMENTS

The present invention will be more fully described by way of the Examples. It is to be understood that the present invention is not limited to the Examples, and various change and modifications may be made in the invention without departing from the spirit and scope thereof.

Examples 1 to 2 and Comparative Examples 1 to 3

A 2.5 μm-thick polyethylene terephthalate film provided on one side thereof with a 0.2 μm-thick sticking-preventive layer composed of a silicone-modified acrylic resin was used as a foundation. Onto the opposite side of the foundation with respect to the sticking-preventive layer was applied and dried a coating liquid for release layer with the following formula, thereby forming a release layer having a melting point of 75° C., a melt viscosity of 12 cps/100° C. and the thickness after being dried as shown in Table 2.

| Coating liquid for release layer | |
|---|---|
| Component | Part by weight |
| Paraffin wax | 8 |
| Toluene | 92 |

Onto the thus formed release layer was applied and dried a coating liquid for color ink layer (magenta or cyan) with the formula shown in Table 1 according to the combination shown in Table 2, thereby forming a 1.5 μm-thick color ink layer having a softening point of 65° C. and a melt viscosity of $1.4\times10^5$ cps/160° C.

Using the thus obtained thermal transfer recording media, superimposing-printing was performed to determine the transfer ratio of the second color ink dot.

Evaluation Method

Figure 2:
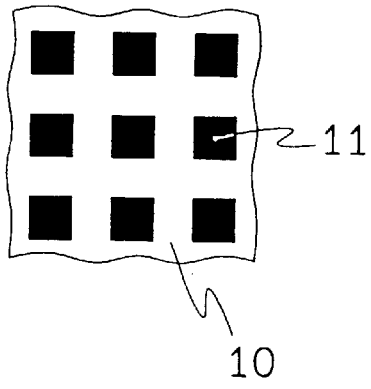
FIG. 2 is a partial plan view showing a printing pattern of second color ink dots which is used in a printing test using the thermal transfer recording medium of the present invention.

Using the thermal transfer recording medium for cyan color (the first color), solid-printing was performed on a sheet of plain paper under the printing conditions mentioned below. Then, one-dot printing was performed in the pattern shown in FIG. 2 under the same printing conditions as above by using the thermal transfer recording medium for magenta color (the second color). In FIG. 2, reference numeral 10 denotes the solid-printed part for the first color, and reference numeral 11 denotes the second color ink dots.

Thermal transfer printer: PCPR 150V made by NEC corp.

Printing energy: 18 mJ/mm$^2$

Printing speed: 100 characters per second

Size of heating element: 80 μm×80 μm

Using the obtained printed matter, the transfer ratio of the second color ink dot defined by the following formula and the superimposing property was evaluated according to the following criterion. The results are shown in Table 2.

$$\text{Transfer ratio}(\%) = \frac{\text{Number of ink dots perfectly transferred/cm}^2}{(\text{Total number of ink dots/cm}^2)} \times 100$$

A: Transfer ratio≧90%

B: 80%≦Transfer ratio<90%

C: Transfer ratio<80%

TABLE 1

| Formula (part by weight) | Magenta | Cyan |
|---|---|---|
| Ethylene-vinyl acetate copolymer*1 | 60 | 60 |
| Petroleum resin | 10 | 10 |
| Carnauba wax | 10 | 10 |
| Billiant Carmine 6B | 20 | |
| Cupper Phthalocyanine Blue | | 20 |
| Toluene | 400 | 400 |

*1: Content of vinyl acetate: 28% by weight, melt flow index: 150/190° C.

TABLE 2

| | Thickness of release layer (μm) | | Transfer ratio of second |
|---|---|---|---|
| | For cyan (first color) | For magenta (second color) | color ink dot (%) |
| Ex. 1 | 0.5 | 0.7 | A |
| Ex. 2 | 0.3 | 0.5 | A |
| Comp. Ex. 1 | 0.8 | 2.0 | C |
| Comp. Ex. 2 | 0.8 | 1.0 | B |
| Comp. Ex. 3 | 0.8 | 0.5 | C |

In addition to the materials and ingredients used in the Examples, other materials and ingredients can be used in the present invention as set forth in the specification to obtain substantially the same results.

The thermal transfer recording medium of the present invention has the structure wherein a release layer comprising a wax as a main ingredient thereof is interposed between a foundation and a color ink layer. However, since the thickness $d_1$ of the first release layer and the thickness $d_2$ of the second release layer have the specific relationship, the second color ink dots can be satisfactorily transferred onto the first color ink dots, resulting in a color image with good color reproducibility.

What is claimed is:

1. A method for forming a color image by superimposing plural different color inks, comprising the steps of:

providing a combination of a plurality of thermal transfer recording media comprising a first color thermal transfer recording medium comprising a first foundation, a first color ink layer provided on the first foundation, and a first release layer comprising a wax interposed between the first foundation and the first color ink layer, and a second color thermal transfer recording medium comprising a second foundation, a second color ink layer provided on the second foundation, and a second release layer comprising a wax interposed between the second foundation and the second color ink layer, wherein the thickness $d_1$ of the first release layer and the thickness $d_2$ of the second release layer satisfy the relationship represented by formula (I):

$$1.1\ d_1 < d_2 < 2.0\ d_1 \quad \text{(I)},$$

and wherein the thickness $d_1$ of the first release layer is from 0.05 to 0.7 $\mu$m, conducting a thermal transfer using the first color thermal transfer recording medium to form a first color image, and conducting a thermal transfer using the second color thermal transfer recording medium to form a second color image on the first color image.

2. The method of claim 1, wherein the first release layer and the second release layer comprise the same wax.

* * * * *